US008960287B2

(12) United States Patent
Holderman et al.

(10) Patent No.: US 8,960,287 B2
(45) Date of Patent: Feb. 24, 2015

(54) ALTERNATIVE PATH GRAVEL PACK SYSTEM AND METHOD

(71) Applicant: Halliburton Energy Services, Inc, Houston, TX (US)

(72) Inventors: Luke William Holderman, Plano, TX (US); Todd Richard Agold, Garland, TX (US); John Charles Gano, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 244 days.

(21) Appl. No.: 13/623,086

(22) Filed: Sep. 19, 2012

(65) Prior Publication Data

US 2014/0076580 A1 Mar. 20, 2014

(51) Int. Cl.
*E21B 43/04* (2006.01)
*E21B 17/20* (2006.01)

(52) U.S. Cl.
USPC ..... 166/278; 166/51; 166/242.2; 166/242.6

(58) Field of Classification Search
USPC ..... 166/278, 51, 242.6, 227, 242.2
See application file for complete search history.

(56) References Cited

U.S. PATENT DOCUMENTS

| | | | | |
|---|---|---|---|---|
| 5,035,285 | A * | 7/1991 | Dickinson et al. | 166/65.1 |
| 5,515,915 | A * | 5/1996 | Jones et al. | 166/51 |
| 5,794,702 | A | 8/1998 | Nobileau | |
| 6,502,634 | B1 * | 1/2003 | Evans et al. | 166/250.03 |
| 6,568,472 | B1 | 5/2003 | Gano et al. | |
| 7,617,873 | B2 | 11/2009 | Lovell et al. | |
| 7,891,423 | B2 | 2/2011 | Dykstra | |
| 7,905,284 | B2 | 3/2011 | Ross et al. | |
| 8,082,993 | B2 | 12/2011 | Craig | |
| 2003/0188865 | A1 * | 10/2003 | McGregor | 166/278 |
| 2004/0140093 | A1 | 7/2004 | Vloedman et al. | |
| 2005/0082060 | A1 * | 4/2005 | Ward et al. | 166/278 |
| 2005/0161232 | A1 * | 7/2005 | Patel et al. | 166/386 |
| 2005/0183862 | A1 * | 8/2005 | Buytaert et al. | 166/379 |
| 2006/0137884 | A1 * | 6/2006 | Torres | 166/380 |
| 2008/0066961 | A1 * | 3/2008 | Aivalis et al. | 175/50 |
| 2008/0128129 | A1 * | 6/2008 | Yeh et al. | 166/275 |
| 2008/0179061 | A1 | 7/2008 | McAfee | |
| 2008/0264650 | A1 * | 10/2008 | Begnaud et al. | 166/381 |

(Continued)

FOREIGN PATENT DOCUMENTS

WO 2014046799 A1 3/2014

OTHER PUBLICATIONS

Holderman, Luke William, et al. PCT Application entitled, "Alternate Path Gravel Pack System and Method", filed Aug. 6, 2013, Int'l Application No. PCT/US13/53672 (4391-05401).

(Continued)

*Primary Examiner* — Jennifer H Gay
(74) *Attorney, Agent, or Firm* — Scott Richardson; Baker Botts L.L.P.

(57) ABSTRACT

A well screen system comprises a wellbore tubular and a coiled shunt tube disposed along the wellbore tubular. The coiled shunt tube is configured to be unwound from a reel. A method of gravel packing comprises passing a slurry through a coiled shunt tube, passing the slurry from the coiled shunt tube to an annulus between an outside of a sand screen assembly and a wellbore wall, disposing the slurry about the sand screen assembly, and forming a gravel pack in response to disposing the slurry about the sand screen assembly. The coiled shunt tube is disposed along the sand screen assembly.

20 Claims, 8 Drawing Sheets

(56) References Cited

U.S. PATENT DOCUMENTS

| | | | | |
|---|---|---|---|---|
| 2010/0018697 | A1* | 1/2010 | Richards et al. | 166/227 |
| 2011/0067863 | A1* | 3/2011 | Peixoto et al. | 166/278 |
| 2011/0132596 | A1* | 6/2011 | Yeh et al. | 166/123 |
| 2011/0147008 | A1* | 6/2011 | Brown | 166/377 |
| 2011/0162840 | A1* | 7/2011 | Haeberle et al. | 166/278 |
| 2012/0024545 | A1* | 2/2012 | Kuo | 166/385 |
| 2012/0061079 | A1 | 3/2012 | Buckman, Sr. et al. | |
| 2012/0205095 | A1* | 8/2012 | Yeh et al. | 166/242.6 |
| 2012/0234532 | A1* | 9/2012 | Kuo | 166/117.6 |
| 2013/0008645 | A1* | 1/2013 | Wetzel et al. | 166/250.01 |
| 2013/0186640 | A1* | 7/2013 | Webre et al. | 166/379 |
| 2013/0248172 | A1* | 9/2013 | Angeles Boza et al. | 166/250.01 |
| 2013/0333893 | A1* | 12/2013 | Morris et al. | 166/312 |
| 2014/0000913 | A1* | 1/2014 | Greci et al. | 166/380 |
| 2014/0076580 | A1* | 3/2014 | Holderman et al. | 166/380 |
| 2014/0231076 | A1* | 8/2014 | Brown | 166/250.01 |

OTHER PUBLICATIONS

Foreign Communication From a Related Counterpart Application—International Search Report and Written Opinion, PCT/US13/53672, Aug. 6, 2013.

* cited by examiner

ALTERNATIVE PATH GRAVEL PACK SYSTEM AND METHOD

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the course of completing an oil and/or gas well, a string of protective casing can be run into the wellbore followed by production tubing inside the casing. The casing can be perforated across one or more production zones to allow production fluids to enter the casing bore. During production of the formation fluid, formation sand may be swept into the flow path. The formation sand tends to be relatively fine sand that can erode production components in the flow path. In some completions, the wellbore is uncased, and an open face is established across the oil or gas bearing zone. Such open bore hole (uncased) arrangements are typically utilized, for example, in water wells, test wells, and horizontal well completions.

When formation sand is expected to be encountered, one or more sand screens can be installed in the flow path between the production tubing and the perforated casing (cased) and/or the open wellbore face (uncased). A packer is customarily set above the sand screen to seal off the annulus in the zone where production fluids flow into the production tubing. The annulus around the screen can then be packed with a relatively coarse sand (or gravel) which acts as a filter to reduce the amount of fine formation sand reaching the screen. The packing sand is pumped down the work string in a slurry of water and/or gel and fills the annulus between the sand screen and the well casing. In well installations in which the screen is suspended in an uncased open bore, the sand or gravel pack may serve to support the surrounding unconsolidated formation.

During the sand packing process, annular sand "bridges" can form around the sand screen that may prevent the complete circumscribing of the screen structure with packing sand in the completed well. This incomplete screen structure coverage by the packing sand may leave an axial portion of the sand screen exposed to the fine formation sand, thereby undesirably lowering the overall filtering efficiency of the sand screen structure.

One conventional approach to overcoming this packing sand bridging problem has been to provide each generally tubular filter section with a series of shunt tubes that longitudinally extend through the filter section, with opposite ends of each shunt tube projecting outwardly beyond the active filter portion of the filter section. In the assembled sand screen structure, the shunt tube series are axially joined to one another to form a shunt path extending along the length of the sand screen structure. The shunt path operates to permit the inflowing packing sand/gel slurry to bypass any sand bridges that may be formed and permit the slurry to enter the screen/casing annulus beneath a sand bridge, thereby forming the desired sand pack beneath it.

SUMMARY

In an embodiment, a well screen system comprises a wellbore tubular, and a coiled shunt tube disposed along the wellbore tubular. The coiled shunt tube is configured to be unwound from a reel.

In an embodiment, a method of gravel packing comprises passing a slurry through a coiled shunt tube, passing the slurry from the coiled shunt tube to an annulus between an outside of a sand screen assembly and a wellbore wall, disposing the slurry about the sand screen assembly, and forming a gravel pack in response to disposing the slurry about the sand screen assembly. The coiled shunt tube is disposed along the sand screen assembly.

In an embodiment, a method for forming a tubular string comprises engaging a coiled shunt tube with a wellbore tubular string, coupling the coiled shunt tube along the wellbore tubular string, and disposing the coupled coiled shunt tube and wellbore tubular string within a wellbore. The wellbore tubular string comprises a plurality of interconnected joints of wellbore tubular, and the coiled shunt tube comprises a continuous length of shunt tube.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
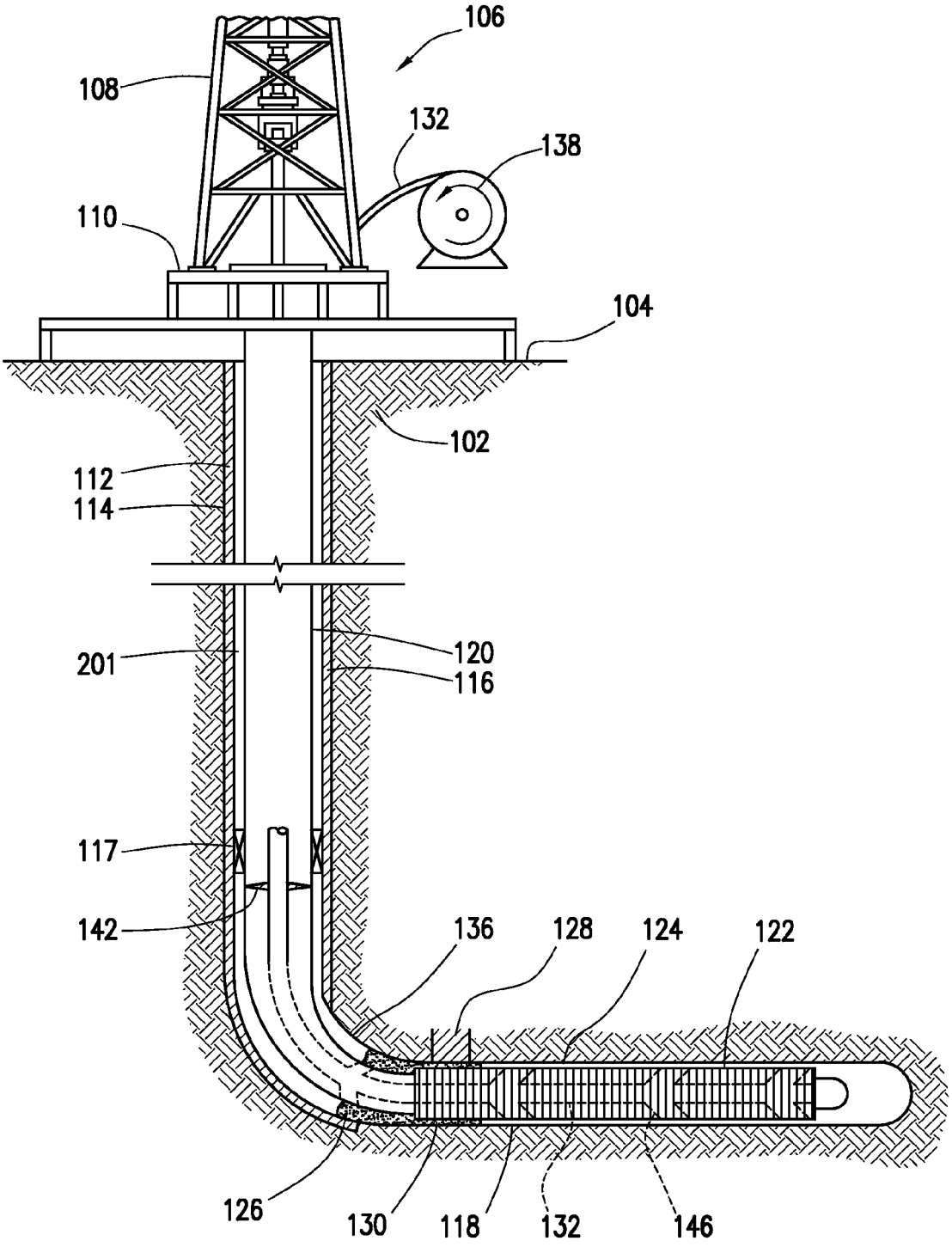
FIG. 1 is a cut-away view of an embodiment of a wellbore servicing system according to an embodiment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "above" meaning toward the surface of the wellbore and with "down," "lower," "downward," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal," "longitudinally," "axial," or "axially" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

The use of shunt tubes with threaded joints of wellbore tubulars that are interconnected often makes it difficult to align each adjacent pair of shunt tubes that must be interconnected to maintain axial continuity in the overall shunt tube flow path. In addition, jumper tubes must be used to couple the facing ends of each adjacent pair of shunt tubes to interconnect and provide fluid communication through the interiors of the shunt tubes in series. These problems tend to make the assembly of the overall sand screen structure relatively difficult and time consuming.

In order to solve these problems, a coiled shunt tube system is disclosed herein that provides a mechanism to allow the performance of an alternative path gravel packing operation without the need for aligning shunt tubes, coupling jumper tubes, and the like. Instead, a coiled shunt tube may be unwound and coupled to an outer surface of the jointed pipe or other tubular as it is installed in the well. Once the coiled shunt tube system has been installed in the well, the well system may be used to perform a gravel packing operation. During the gravel packing operation, the coiled shunt tube system may be used to provide an alternative path for the gravel slurry and/or the slurry may be provided to the coiled shunt tube system through a wellbore tubular (e.g., a coiled tubing).

In some embodiments, a coiled shunt tube system may be configured to axial translate along a completion string. In this embodiment, the coiled shunt tube may be retracted from the well as a gravel slurry is pumped into the well through the coiled shunt tube, forming a gravel pack first at a downhole terminal end of the well and then depositing the gravel slurry uphole as the coiled shunt tube is displaced upward in the well. At a certain point in the gravel packing operation, the coiled shunt tube may be disconnected at a disconnect mechanism, allowing for a portion of the coiled tubing to be retracted from the well while leaving a downhole portion of the coiled tubing within the well.

Referring to FIG. 1, an example of a wellbore operating environment in which a well screen assembly may be used is shown. As depicted, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 may be drilled into the subterranean formation 102 using any suitable drilling technique. The wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multi-lateral wellbore, and other types of wellbores for drilling and completing one or more production zones. Further, the wellbore may be used for both producing wells and injection wells. The wellbore may also be used for purposes other than hydrocarbon production such as geothermal recovery and the like.

A wellbore tubular 120 may be lowered into the subterranean formation 102 for a variety of drilling, completion, workover, treatment, and/or production processes throughout the life of the wellbore. The embodiment shown in FIG. 1 illustrates the wellbore tubular 120 in the form of a completion assembly string comprising a well screen assembly 122 disposed in the wellbore 114. In an embodiment, wellbore tubular 120 may comprise one or more centralizers 142 configured to position wellbore tubular 120 centrally within wellbore 114. It should be understood that the wellbore tubular 120 is equally applicable to any type of wellbore tubulars being inserted into a wellbore including as non-limiting examples jointed pipe, drill pipe, casing, liners, coiled tubing, and any combination thereof. Further, the wellbore tubular 120 may operate in any of the wellbore orientations (e.g., vertical, deviated, horizontal, and/or curved) and/or types described herein. In an embodiment, the wellbore may comprise wellbore casing 112, which may be cemented into place in at least a portion of the wellbore 114.

In an embodiment, the wellbore tubular 120 may comprise a completion assembly string comprising one or more downhole tools (e.g., zonal isolation devices 117, screens assemblies 122, valves, etc.). The one or more downhole tools may take various forms. For example, a zonal isolation device 117 may be used to isolate the various zones within a wellbore 114 and may include, but is not limited to, a packer (e.g., production packer, gravel pack packer, frac-pac packer, etc.). While FIG. 1 illustrates a single screen assembly 122, the wellbore tubular 120 may comprise a plurality of screen assemblies 122. The zonal isolation devices 117 may be used between various ones of the screen assemblies 122, for example, to isolate different gravel pack zones or intervals along the wellbore 114 from each other.

The workover and/or drilling rig 106 may comprise a derrick 108 with a rig floor 110 through which the wellbore tubular 120 extends downward from the drilling rig 106 into the wellbore 114. The workover and/or drilling rig 106 may comprise a motor driven winch and other associated equipment for conveying the wellbore tubular 120 into the wellbore 114 to position the wellbore tubular 120 at a selected depth. The workover and/or drilling rig 106 may also comprises a section of a coiled shunt disposed on a reel 138, which may be configured to allow for the unreeling of coiled shunt tube 132. In this embodiment, as the wellbore tubular 120 is introduced to the wellbore 114, the coiled shunt tube 132 may be strapped or clamped to the wellbore tubular 120, as will be discussed further herein. In an embodiment, in order to couple the coiled shunt tube 132 to the wellbore tubular 120, multiple slip bowls may be used to enable the wellbore tubular 120 to be coupled together, where the wellbore tubular 120 can comprise jointed pipe. In this embodiment, a screen table may be employed with a second set of slip bowls disposed at the screen table. In an embodiment, a slip bowl comprising a channel to allow for the passage of the coiled shunt tube 132 coupled to an outer surface of the wellbore tubular 120 may be used to introduce the wellbore tubular 120 and the coiled shunt tube 132 into the wellbore 114. For example, such an embodiment may resemble the way control lines and other equipment are coupled to a wellbore tubular, such as wellbore tubular 120, before being introduced into the wellbore. While the operating environment depicted in FIG. 1 refers to a stationary workover and/or drilling rig 106 for conveying the wellbore tubular 120 within a land-based wellbore 114, in alternative embodiments, mobile workover rigs, wellbore servicing units (such as coiled tubing units), and the like may be used to convey the wellbore tubular 120 within the wellbore 114. It should be understood that a wellbore tubular 120 may alternatively be used in other operational environments, such as within an offshore wellbore operational environment.

In use, the screen assembly 122 can be positioned in the wellbore 114 as part of the wellbore tubular string 120 adjacent a hydrocarbon bearing formation. An annulus 124 is formed between the screen assembly 122 and the wellbore 114. Upon positioning of wellbore tubular 120 and assembly 122 within the wellbore 114, gravel slurry 126 may travel through the annulus 124 between the well screen assembly 122 and the wellbore 114 wall as it is pumped down the wellbore around the screen assembly 122. Upon encountering a section of the subterranean formation 102 including an area of highly permeable material 128, the highly permeable area 128 can draw liquid from the slurry, thereby dehydrating the slurry. As the slurry dehydrates in the permeable area 128, the remaining solid particles form a sand bridge 130 and prevent further filling of the annulus 124 with gravel.

In an embodiment, a coiled shunt tubes 132 may be used to create an alternative path for gravel around the sand bridge 130. The coiled shunt tubes 132 may comprise transport tubes and/or packing tubes, one or more of which may be configured to be coiled on a reel. The one or more packing tubes may be disposed in fluid communication with the one or more transport tubes. A first end of the packing tubes may be coupled to the one or more transport tubes at various points along the length of the transport tubes, and the packing tubes may comprise a series of perforations providing fluid communication within and/or through the outer body member at a second end. As shown schematically in FIG. 1, the coiled shunt tubes 132 may form a branched structure along the length of a screen assembly with the one or more transport tubes forming the trunk line and the one or more packing tubes forming the branch lines. In an embodiment, a plurality of branched structures may extend along the length of the screen assembly 122. The use of a plurality of branched structures may provide redundancy to the coiled shunt tubes system in the event that one of the branched structures is damaged, clogged, or otherwise prevented from operating as intended.

In use, the branched configuration of the transport tubes and packing tubes may provide the fluid pathway for a slurry to be diverted around a sand bridge 130. Upon the formation of a sand bridge 130, a back pressure generated by the blockage may cause the slurry carrying the sand to be diverted through the one or more transport tubes until bypassing the sand bridge 130. The slurry may then pass out of the one or more transport tubes into the one or more packing tubes. While flowing through the one or more packing tubes, the slurry may pass through the perforations in the packing tubes and into the annular space 124 about the wellbore tubular 120 to form a gravel pack.

Figure 2:
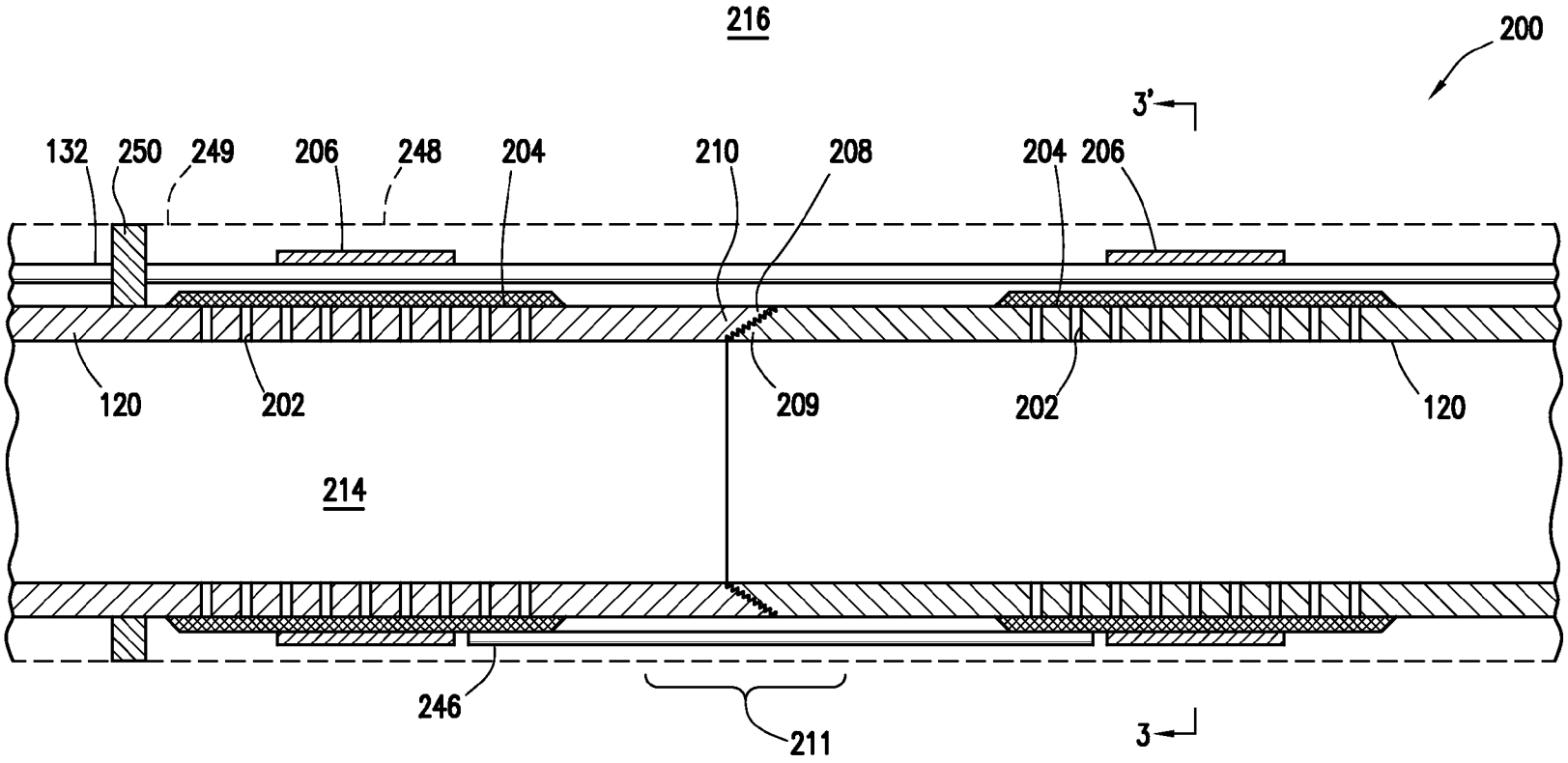
FIG. 2 is a cross-sectional view of an embodiment of a coiled tubing assembly.

A cross-sectional view of an embodiment of a wellbore tubular comprising a coiled shunt tube assembly 200 disposed thereabout is shown in FIG. 2. The wellbore tubular 120 generally comprises a series of perforations 202 disposed therethrough. A filter media 204 is disposed about the wellbore tubular 120 and the series of perforations 202 to screen the incoming fluids from the formation. The coiled shunt tube assembly 200 comprises one or more continuous lengths of a tubular disposed along and generally parallel to the wellbore tubular 120 and one or more retaining members 206 disposed about coiled shunt tube 132 and the wellbore tubular 120. The coiled shunt tube 132 may comprise a continuous length of a shunt tube, including one or more transport tubes and/or packing tubes, which may be configured to be wound on a spool or reel. The coiled shunt tube 132 may be straightened and/or formed prior to being coupled to the wellbore tubular 120. In an embodiment, the length of the coiled shunt tube 132, or a section thereof, may be greater than the length of two joints of wellbore tubular, greater than the length of three joints of wellbore tubular, or greater than the length of four joints of wellbore tubular. The coiled shunt tube 132 may be wound onto the spool or reel in a manner configured to allow the coiled shunt tube 132 to be unwound and coupled to the wellbore tubular to form the coiled shunt tube system.

In an embodiment, one or more lengths of coiled shunt tube 132 may coupled together to form a continuous fluid pathway the overall length of the coiled shunt tube disposed along the length of the well screen assembly. For example, the overall length of the coiled shunt tube may be formed by unwinding a first length of coiled shunt tube from one spool and coupling the first coiled shunt tube to the wellbore tubular. A second section of coiled shunt tube may then be coupled to the end of the first coiled shunt tube and the coupling process may continue along the length of the wellbore tubular. Since the coupling between the first and second sections of coiled shunt tubes occurs at or near the end of the first section, the coupling may not align with the coupling between adjacent joints of wellbore tubular. In an embodiment, one or more transport tubes may be coupled between adjacent lengths of coiled shunt tubes.

In an embodiment, a coiled shunt tube system may be formed using different lengths of coiled shunt tubes that are concurrently unwound and coupled to the wellbore tubular. For example, one or more transport tubes may be disposed on a first reel and one or more lengths of packing tubes may be disposed on a second reel. The first and second reels may be concurrently unwound and the lengths of packing tubes may be coupled to the transport tubes as the reels are unwound and coupled to the wellbore tubular. In some embodiments, the coiled shunt tubes may be pre-coupled and wound onto a reel as a pre-formed coiled shunt tube assembly. In some embodiments, two or more coiled shunt tubes may be unwound and coupled to the wellbore tubular. The coiled shunt tubes may be of the same or similar configurations, which may provide some redundancy to the coiled shunt tube system in the event that one or more of the coiled shunt tubes are damaged or blocked during installation in the wellbore. In an embodiment, packing tubes may be coupled to the coiled tubing 132 after tubing 132 has been coupled to the wellbore tubular 120 via retaining members 206.

Retaining members 206 may be configured to retain and/or couple coiled shunt tube 132 to the wellbore tubular 120, for example so that coiled shunt tube 132 may be disposed in the wellbore (such as wellbore 114 of FIG. 1). In an embodiment, coiled shunt tube 132 may be coupled to wellbore tubular 120 without a protective shroud disposed about the tubing 132, in order to allow for the tubing 132 to be coupled to the wellbore tubular 120 as the tubular is introduced into the well. In an embodiment, retaining members 206 may comprise a band and/or a clamp. In an embodiment, retaining member 206 may comprise a clamp similar to those used to clamp control lines to tubulars similar to wellbore tubular 120.

In an embodiment, the retaining members 206 may comprise retaining rings 250 used to retain the coiled shunt tubes 132, the outer body member 249, and/or in some embodiments, the filter media 204 in position relative to the wellbore tubular 120. The retaining rings 250 may comprise rings and/or clamps configured to engage and be disposed about the wellbore tubular 120. The retaining ring 250 may engage the wellbore tubular using any suitable coupling including, but not limited to, corresponding surface features, adhesives, curable components, spot welds, any other suitable retaining mechanisms, and any combination thereof. For example, the inner surface of the retaining ring 250 may comprise corrugations, castellations, scallops, and/or other surface features, which in an embodiment, may be aligned generally parallel to the longitudinal axis of the wellbore tubular 120. The corresponding outer surface of the wellbore tubular 120 may comprise corresponding surface features that, when engaged, couples the retaining rings 250 to the wellbore tubular 120. In an embodiment, the retaining rings may be hinged to allow the retaining rings to be placed about the wellbore tubular 120. In some embodiments, the retaining rings may comprise one or more hinged portions configured to open and receive one or more of the coiled shunt tubes 132, allowing the coiled shunt tubes 132 to be engaged during the makeup of the wellbore tubular string.

The filter media 204 may be disposed about the wellbore tubular 120 and can serve to limit and/or prevent the entry of sand, formation fines, and/or other particular matter into the wellbore tubular 120. In an embodiment, the filter media 204 is of the type known as "wire-wrapped," since it is made up of a wire closely wrapped helically about a wellbore tubular 120, with a spacing between the wire wraps being chosen to allow fluid flow through the filter media 204 while keeping particulates that are greater than a selected size from passing between the wire wraps. While a particular type of filter media 204 is used in describing the present invention, it should be understood that the generic term "filter media" as used herein is intended to include and cover all types of similar structures which are commonly used in gravel pack well completions which permit the flow of fluids through the filter or screen while limiting and/or blocking the flow of particulates (e.g. other commercially-available screens, slotted or perforated liners or pipes; sintered-metal screens; sintered-sized, mesh screens; screened pipes; prepacked screens and/or liners; or combinations thereof).

The wellbore tubular 120 comprises the series of perforations 202 through the wall thereof. The wellbore tubular 120 may comprise any of those types of wellbore tubular described above with respect to FIG. 1. While the wellbore tubular 120 is illustrated as being perforated in FIG. 2, the wellbore tubular 120 may be slotted and/or include perforations of any shape so long as the perforations permit fluid communication of production fluid between an interior throughbore 214 and an exterior 216 of the coiled tubing assembly 200. In an embodiment the perforations 202 may be disposed in generally radial alignment with the filter media 204.

In some embodiments, a production sleeve may be provided. In this embodiment, the wellbore tubular 120 adjacent the filter media 204 may not be perforated, and rather an annulus may be formed between the filter media 204 and the wellbore tubular 120. The annulus may be in fluid communication with the production sleeve, and fluid flowing through the filter media 204 may travel along the annulus to the production sleeve. One or more perforations may be disposed in the production sleeve to permit fluid communication of production fluid between an interior throughbore 214 and an exterior 216 of the coiled tubing assembly 200. In this embodiment, various flow control mechanisms (e.g., flow restrictions, flow valves, etc.) may be disposed within the production sleeve to control the flow of fluids into the interior throughbore 214.

Adjacent sections or joints of wellbore tubulars 120 may be coupled at a joint 208 formed between a pin end 209 and a box end 210. As can be seen in FIG. 2, the wellbore tubular 120 may have a section 211 that extends beyond the coiled tubing assembly 200. The exposed portion 211 of the wellbore tubular 120 may be used during the coupling process to allow one or more tools to engage the exposed portion 211 and thread the joint to an adjacent joint of wellbore tubular.

Figure 3A:
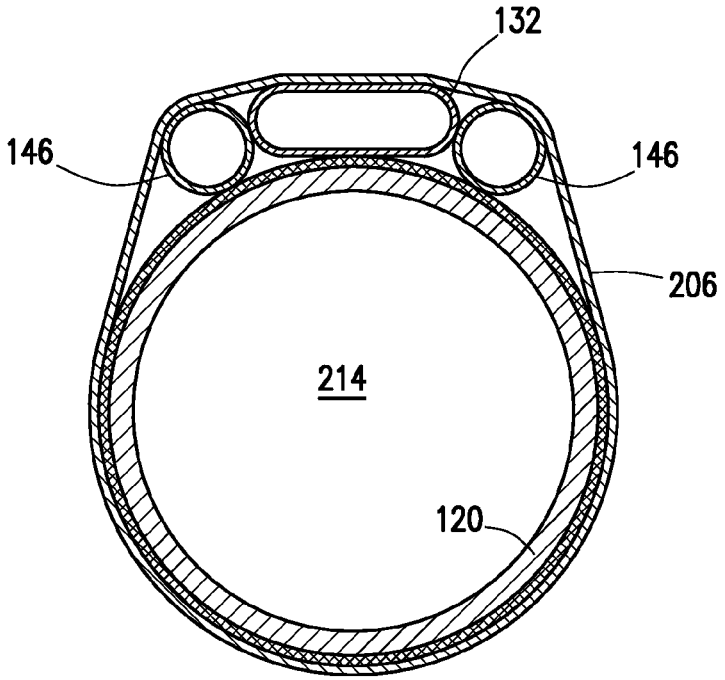
FIGS. 3A-3C are cross-sectional views of embodiments of a coiled tubing assembly along line 3-3' of FIG. 2.
Figure 3B:
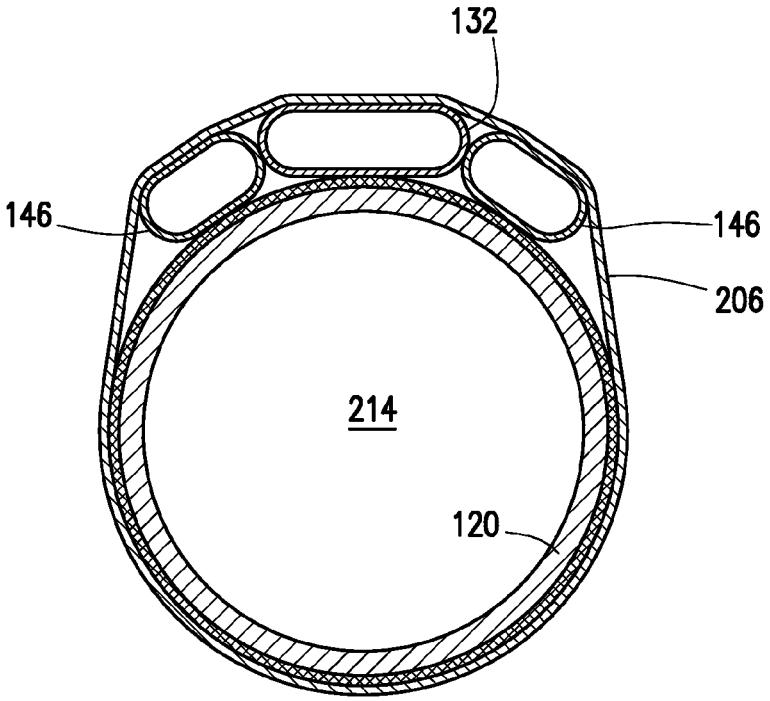
Figure 3C:
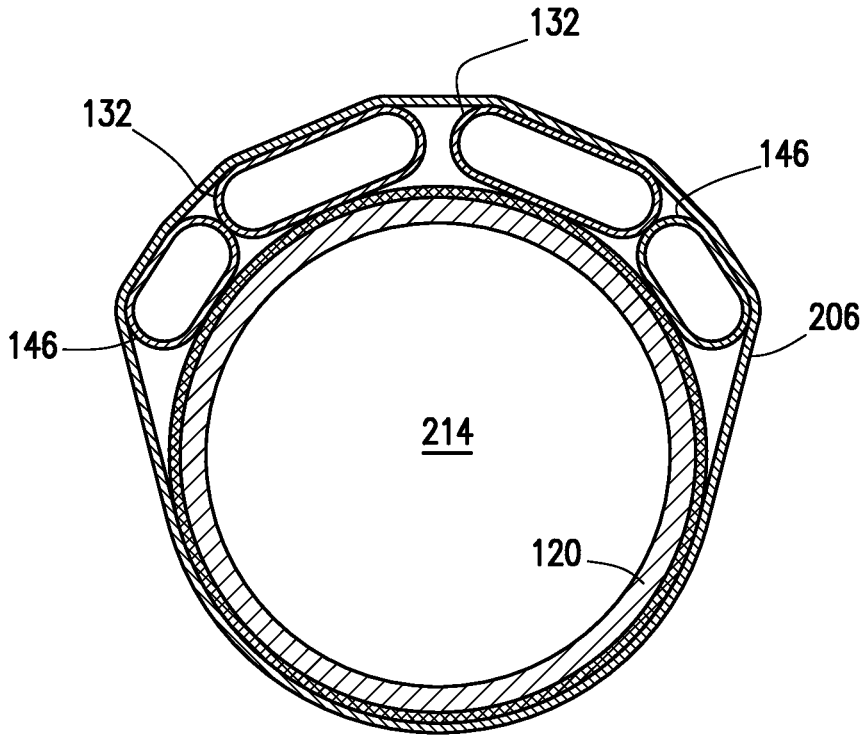

The coiled shunt tube 132 may be disposed outside of and generally parallel to the wellbore tubular 120, though other positions and alignment may be possible. While described as tubular members, one or more of the coiled shunt tubes 132 may have shapes other than cylindrical and may generally be rectangular, oblong, trapezoidal, and/or kidney shaped in cross-section. The coiled shunt tube 132 may be eccentrically aligned with respect to the wellbore tubular 120 as best seen in FIGS. 3A-3C. While illustrated in FIGS. 2 and 3 as having an eccentric alignment, other alignments of the one or more lengths of the coiled shunt tube about the wellbore tubular 120 also may be possible.

Various configurations for providing fluid communication between the interior of the coiled shunt tube 132 and the exterior 216 of tubular 120 are possible. In an embodiment, the coiled shunt tube 132 may comprise a series of perforations. Upon the formation of a sand bridge, a back pressure generated by the blockage may cause the slurry carrying the sand to be diverted through the coiled shunt tube 132 until bypassing the sand bridge. The slurry may then pass out of the coiled shunt tube 132 via the perforations in the coiled shunt tube 132 and into the exterior 216 about the wellbore tubular 120 to form a gravel pack.

In an embodiment, the coiled shunt tube 132 may comprise one or more transport tubes 132 in fluid communication with one or more packing tubes 146. As illustrated in FIGS. 1 and 3A-3C, the transport tubes 132 and the packing tubes 146 may generally comprise tubular members disposed outside of and generally parallel to the wellbore tubular 120. As shown schematically in FIG. 1, the packing tubes 146 may form a branched structure along the length of a screen assembly 122 with the transport 132 forming the trunk line and the one or more packing tubes 146 forming the branch lines. The one or more packing tubes 146 may be disposed generally parallel to the transport tubes 132 and may be coupled to the tubing 132 via welding or another coupling means. The packing tubes 146 may be coupled to the transport tubes 132 at various points along their length at one end and comprise a series of perforations providing fluid communication to the exterior 216 over their length. In an embodiment, one or more nozzles may be used to provide fluid communication between the packing tubes 146 and the exterior 216.

FIGS. 3A-3C illustrate several exemplary configurations of a coiled shunt tube assembly 200 as shown with a cross-sectional view along line 3-3' of FIG. 2. As illustrated, the coiled shunt tubes comprise transport tubes 132 and packing tubes 146. The packing tubes 146 and the transport tubes 132 may have cylindrical cross-sections or rectangular cross-sections. In an embodiment, the transport tubes 132 and/or the packing tubes 146 may be configured to inflate and/or change their cross-sectional shape in response to having a slurry or fluid pumped through them. In this embodiment, retaining member 206 may be configured to stretch in response to the change in shape of the transport tubes 132 and/or packing tubes 146. In another embodiment, retaining member 206 may be configured to restrict any expansion of the transport tubes 132 and/or packing tubes 146 in response to being internally pressurized by a fluid flowed through the transport tubes 132 and/or the packing tubes 146. As shown in FIGS. 3A-3C, the retaining member 206 may take the form of a band, a clamp, or any other form configured to retain the transport tubes 132 and/or the packing tubes 146 adjacent to the wellbore tubular 120.

In an embodiment, one or more leakoff tubes 246 may be optionally disposed along the length of the coiled shunt tube assembly 200. The leakoff tubes 246 may be configured to provide a leakoff path for fluid in the slurry 126 to enter the wellbore tubular 120. For instance, the leakoff tubes 246 may be disposed at blank sections of the wellbore tubular 120 (e.g., sections without perforations in the wellbore tubular 120) to allow for the flow of fluid in the slurry 126 to enter the wellbore tubular 220. At these sections, the leakoff tubes may be perforated or slotted to provide for a route of fluid communication from an exterior of the tubular member 220 to an area proximal to perforations within the wellbore tubular 220.

In an embodiment, one or more leakoff tubes 246 may be disposed about wellbore tubular 220 at exposed portion 211. The leakoff tubes 246 are configured to provide for a route of fluid communication between fluid in the exterior 216 and perforations 146 of wellbore tubular 120 so that the fluid may drain to the surface via throughbore 214 of wellbore tubular 120. Leakoff tubes 246 comprise a plurality of perforations, slots, or other means for providing a route of fluid communication to an internal throughbore of the leakoff tubes 246. While in this embodiment leakoff tubes 246 are shown as one or more short sections of tubing, in an embodiment leakoff tubes 246 may run along the entire length of the wellbore tubular 120, from the surface to a downhole end of the wellbore tubular 120.

To protect the coiled shunt tubes 132 and/or filter media 204 from damage during installation of the screen assembly comprising the coiled shunt tubes assembly 200 within the wellbore, one or more optional centralizers 142 configured to position tubular member 120 and tubing assembly 200 within a central portion of the wellbore 114 may be used. In an embodiment, tubular member 120 may include one or more centralizers 142 coupled to an outer surface of wellbore tubular 120. In this embodiment, coiled tubing 132 may be configured to extend across one or more centralizers 142 as it extends along tubular member 120. In an embodiment, retaining members 206 of coiled tubing assembly 200 may include a centralizer 142.

In some embodiments, an outer body member 249 may be positioned about a portion of the coiled tubing assembly 200 to protect the coiled shunt tubes 132, the optional leakoff tubes 246, the retaining members 206, and/or the filter media 204 from damage during installation of the screen assembly comprising the coiled tubing assembly 200 within the wellbore. The outer body member 248 comprises a generally cylindrical member formed from a suitable material (e.g. steel) that can be secured at one or more points to the tubular member 120 and/or coiled tubing 232. The outer body member 248 may have a plurality of openings 249 (only one of which is numbered in FIG. 2) through the wall thereof to provide fluid communication therethrough during production. By positioning the outer body member 248 over the coiled shunt tube assembly 200, the coiled shunt tube 232, leakoff tubes 246, and/or filter media 204 may be protected from any accidental impacts during the assembly and installation of the screen assembly in the wellbore that might otherwise damage or destroy one or more components of the screen assembly or the coiled tubing assembly 300.

Referring to FIGS. 1-3C, the coiled shunt tube system may be used in one or more operations. In an embodiment, a wellbore 114 may be provided within a subterranean formation 102. A rig 106 may also be provided that is suitable for performing a completion operation for the wellbore 114 that may include the installation of a gravel pack in a portion of the wellbore 114. A wellbore tubular 120 may be introduced or run into the wellbore 114 at the rig 106. As part of running the wellbore tubular 120 into the wellbore 114, a coiled shunt tube 132 may be coupled to the wellbore tubular 120 before, during, or after the wellbore tubular 120 is run into the wellbore 114, forming a well screen assembly 122 comprising the wellbore tubular 120, coiled shunt tube 132, and a filter media 204. In an embodiment, this coupling procedure may be performed using a screen table at the rig 106 with a second set of slip bowls used to position and provide downhole passage for the wellbore tubular 120 and coiled tubing 132. Also, as part of this coupling procedure, the coiled tubing 132 may be coupled (e.g., strapped, banded, and/or clamped) to the wellbore tubular 120.

Once the coiled shunt tube 132 has been coupled to the wellbore tubular 120, the wellbore tubular 120 and coiled shunt tube 132 may be conveyed through wellbore 114 until the well screen assembly 122 is disposed at a suitable portion of the formation 102. A gravel slurry 126 may then be pumped down to the well screen assembly 122. As part of the gravel packing procedure, a sand bridge 130 may form within a portion of the annulus 124. Upon formation of a sand bridge 130, gravel slurry 126 may continue to be pumped into the wellbore 114, allowing it to enter the coiled shunt tube system 132 and bypass the sand bridge 130. Upon the pumping of a suitable amount of gravel slurry 126 into the wellbore 114, a gravel pack 146 may form within a portion of the wellbore 114. Upon the formation of a suitable gravel pack, formation fluid may be produced from the formation 102 through an internal throughbore 214 of the tubular 120 to the surface.

Figure 4:
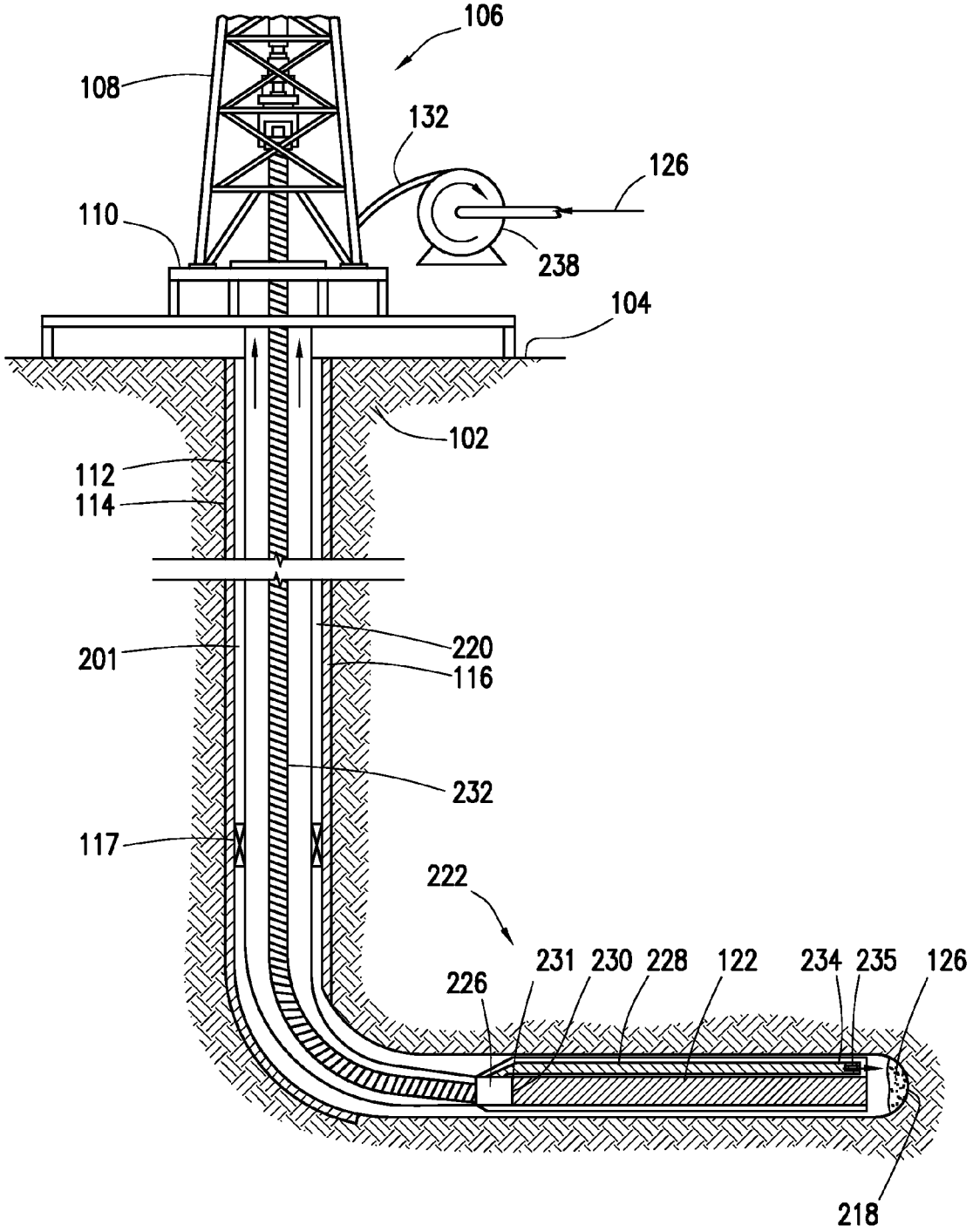
FIG. 4 is a cut-away view of another embodiment of a wellbore servicing system according to an embodiment.

Referring to FIG. 4, another example of a wellbore operating environment in which a well screen assembly may be used is shown. This configuration is similar in many respects to the configuration of FIG. 1. However, in this embodiment the coiled shunt tube 232 may be similar to coiled tubing, and the coiled shunt tube 232 may be at least partially disposed on the exterior of the wellbore tubular 120. The resulting completion assembly string comprises a downhole section 222 that generally includes a well screen assembly 122, a continuous section of coiled shunt tube 232, and crossover tool 226 disposed in the wellbore 114. In the downhole section 222 the coiled shunt tube 232 may be disposed about the screen assembly 122 of wellbore tubular 220. In this embodiment, the coiled shunt tube 232 may transition from being disposed exterior of the wellbore tubular 220 to interior of the tubing 220. In some embodiments, the coiled shunt tube may be disposed on the exterior of the wellbore tubular along its entire length. In an embodiment, crossover tool 226 is configured to allow for the internal/external transition of the coiled shunt tube 232 as it passes through an internal throughbore of the crossover tool 226. In an embodiment, the crossover tool 226 may comprise a slot that extends from the internal throughbore of the crossover tool 226 to an exterior of the tool 226, allowing for the throughbore of coiled shunt tube 232 through the slot. Above the crossover tool 226, the coiled shunt tube 232 may extend to the surface 104 and rig 106 via an internal throughbore of the wellbore tubular 220. At the rig 106 a coiled shunt tube reel 238 may be configured to reel and unreel the coiled shunt tube 232.

In this embodiment, the coiled shunt tube 232 may be configured to receive the gravel slurry 126 at the surface 104. The slurry 126 may be conveyed into the wellbore 114 via an internal throughbore of the coiled tubing 232. In this embodiment, coiled tubing 232 may not comprise perforations or other means to communicate fluid to an exterior of the coiled tubing 232 except at or near the terminal end 234 of the coiled shunt tube 232. Thus, the slurry 126, once having been introduced into the coiled tubing 232 at the surface 104, may exit tubing 232 only at or near the terminal end 234. As the slurry 126 is deposited adjacent the terminal end of the coiled shunt tube 232, well screen assembly 122 and outer member 228 may be configured to allow the passing of the liquid carrier fluid from the slurry 126 into the wellbore tubular 220 such that it may be returned to the surface 104 via an internal throughbore of the wellbore tubular 220 and/or the annulus between the wellbore tubular 220 and the wellbore 114 wall. In this embodiment, the downhole section 222 may include leakoff tubes disposed about the well screen assembly 122. For example, the leakoff tubes may be disposed at blank sections of the wellbore tubular 220, where no perforations in the wellbore tubular 220 exist to allow for the flow of water or other fluid in the slurry 126 to enter the wellbore tubular 220.

In this embodiment, as the slurry 126 is deposited at the downhole end 218 of wellbore 114, a reel 238 may be configured to reel tubing 232 uphole as the wellbore 114 becomes filled with slurry 126. The rate at which coiled tubing 232 is displaced upward within wellbore 114 can be determined, at least in part, based on the rate and volume of slurry 126 displaced through coiled tubing 232 and/or the characteristics of the wellbore. Since the slurry 126 is not introduced into the wellbore 114 via the annulus 201 at the surface 104, thereby removing any possible leak off paths from permeable zones in the formation 102, the density of the slurry 126 may range as high as about 10 to about 15 pounds of sand or gravel per gallon of slurry. In an embodiment, a pressure sensor 235 may be disposed at or near the terminal end 234 of coiled shunt tube 232, which may transmit a signal to the surface 104 indicating the pressure at the downhole terminal end 234. In this embodiment, the signal generated by the pressure sensor 235 may be used to adjust the rate at which the coiled tubing 232 is displaced upward and/or the rate at which the slurry is injected into the wellbore 114. In this embodiment, the reel 238 and coiled tubing 232 may be configured to gravel pack the wellbore 114 beginning with the downhole end 218 and moving upward as coiled tubing 232 is displaced upward within wellbore 114. For instance, a pressure increase indicated by the sensor 235 may indicate the presence of gravel or slurry 126 at or near the terminal end 234 of coiled tubing 232, indicating that the coiled tubing 232 may be displaced upward in the wellbore 114 to allow gravel packing of a further uphole section of the wellbore 114. In some embodiments, the sensor 235 may be used to operate a valve or choke at the terminal end 234 of the coiled shunt tube 232. The resulting pressure signal and/or change in flow rate through the coiled shunt tube 232 may be detected at the surface, and the rate of conveying the coiled shunt tube 232 within the wellbore may be adjusted in response to the change in pressure and/or flowrate.

In an embodiment, well screen assembly 122 may further comprise a sliding sleeve 230 that is disposed at an upward end 231 of the well screen assembly 122. The sliding sleeve 230 is configured to close the crossover tool 226, thus sealing or at least restricting the passage of fluid between an internal throughbore of the wellbore tubular 220 and an exterior of the tubing 220 at the crossover tool 226. In an embodiment, the sliding sleeve 230 may be actuated upon the coiled shunt tube 232 having been displaced upward to a point where an indicator on the coiled shunt tube 232 has passed through the crossover tool 226.

Figure 5:
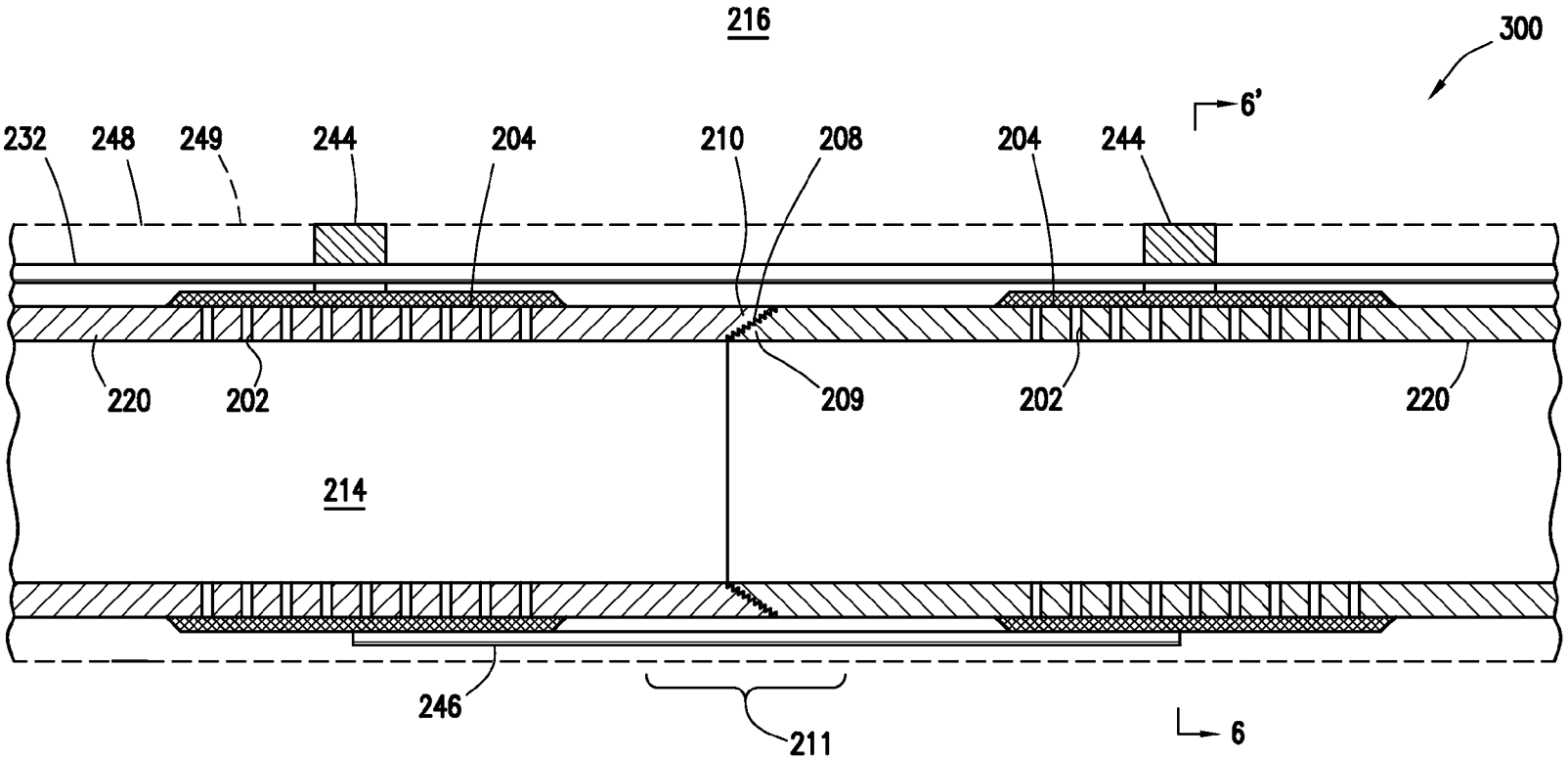
FIG. 5 is a cross-sectional view of an embodiment of a coiled tubing assembly.

A cross-sectional view of an embodiment of a wellbore tubular comprising a coiled tubing assembly 300 disposed thereabout is shown in FIG. 5. This configuration is similar in many respects to the configuration of FIG. 2. However, the coiled shunt tube assembly 300 comprises a coiled shunt tube 232 similar to coiled tubing disposed along and generally parallel to the wellbore tubular 220 and one or more retaining members 244 disposed about coiled tubing 232 and wellbore tubular 220. The retaining members 244 may be configured to loosely retain the coiled shunt tube 232 such that the coiled shunt tube 232 may not wrap around the circumference of the wellbore tubular 220 during installation of the wellbore tubular 220 in the wellbore, but may allow freedom of axial movement such that coiled shunt tube 232 may be translated (e.g., translated upwards) when installed in the wellbore. In an embodiment, the retaining members 244 may comprise a bracket or other mechanism disposed about and coupled to the wellbore tubular 220. In another embodiment, the retaining members 244 may comprise horseshoe style clamps that are configured to allow the coiled tubing 232 to axially translate along the wellbore tubular 220. In an embodiment, an optional outer body member 248 may be disposed about the wellbore tubular 220, coiled tubing 232, and/or filter media 204.

As discussed earlier, because coiled tubing 232 only allows for fluid communication to the wellbore at a downhole terminal end 234 of the tubing 232, fluid within a gravel slurry 126 may not prematurely leakoff into a permeable zone of the adjacent formation, thus reducing the risk of the coiled tubing 232 plugging due to dehydration of the slurry 126. Further, because the coiled tubing system 300 is configured to pack the wellbore from the bottom up, the risk of forming of sand bridges may be reduced or eliminated.

Figure 6:
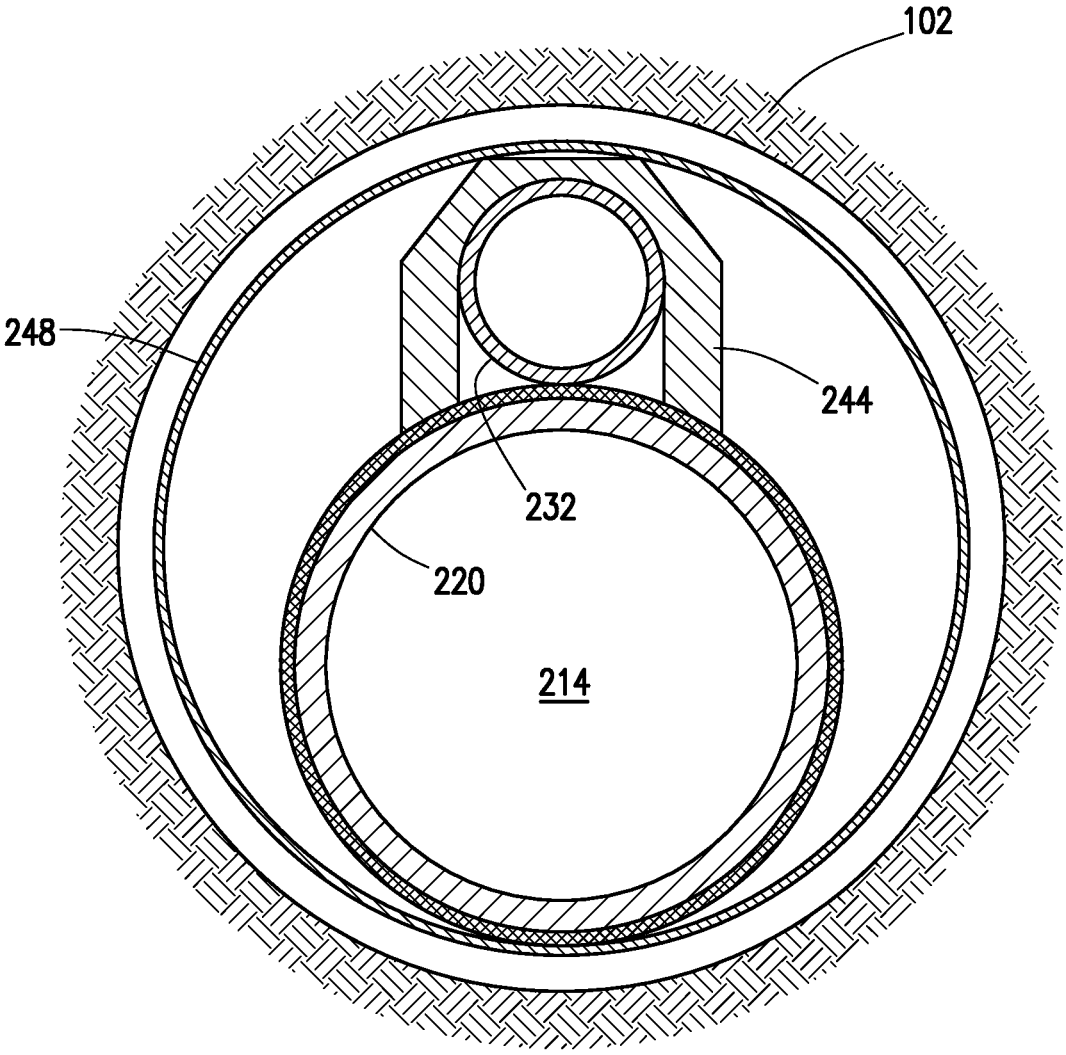
FIG. 6 is cross-sectional views of an embodiment of a coiled tubing assembly along line 6-6' of FIG. 5.

Referring to FIGS. 4-6, a wellbore tubular 220 comprising a well screen assembly 122 may be introduced or run into the wellbore 114 at the rig 106. In this embodiment, the well screen assembly 122 may comprise a crossover tool 226, coiled shunt tube 232, a filter media 204, and optionally, a shroud or outer member 248. As the well screen assembly 122 is run into the wellbore 114, the coiled shunt tube 232 is disposed outside of the wellbore tubular 220 in the screen section and be coupled to the crossover tool 226, where the coiled shunt tube may extend to the surface of the wellbore through the interior of the wellbore tubular 220. The wellbore tubular 220 and screen assembly 122 may be run into the well until the assembly 122 is disposed within a suitable portion of the formation 102.

A gravel slurry 126 suitable for forming a gravel pack may be pumped into the coiled shunt tube 232 at the surface 104 where it may be pumped into the wellbore 114 via the coiled shunt tube 232. As the slurry 126 is pumped into the wellbore 114, it may be displaced out of a terminal end 234 of the coiled shunt tube 232 where it may begin to form a gravel pack within the wellbore 114. As the slurry 126 is emitted from the terminal end 234, the coiled shunt tube 232 may be retracted via coiled tubing reel 238 at a rate determined at least in part by the concentration and volume of slurry pumped into the wellbore 114. In an embodiment, the gravel slurry pumped into the wellbore 114 may have a density ranging between about 10 and about 15 pounds of sand or gravel per gallon of slurry. In an embodiment, a pressure sensor may be disposed proximal to the terminal end 234 of the coiled tubing 232. In this embodiment, the rate of retraction of the coiled tubing 232 out of the wellbore 114 may be adjusted in response to a pressure detected by the pressure sensor disposed within the wellbore 114. For instance, as the pressure signal increases the rate of displacement of the coiled tubing 232 may be increased, as a higher pressure signal may indicate the presence of gravel or the forming of a gravel pack at or near to the sensor and the terminal end 234 of the coiled shunt tube 232.

As the coiled tubing 232 is retracted upward, the terminal end 234 and/or an indicator disposed at or near the terminal end may pass through the crossover tool 226. At this point, the crossover tool 226 may be closed via a sliding sleeve 230 of the well screen assembly 122. While described in terms of the coiled shunt tube 232 actuating the crossover tool 226, it is understood that an obturating member, such as a ball or dart, may be pumped down the wellbore tubular 220 from the surface and used to actuate the sliding sleeve 230. This engagement between the crossover tool 226 and sliding sleeve 230 may close the slot of the crossover tool 226. The coiled shunt tube 232 may be continuously retracted upward as slurry 126 is pumped downward through the tubing 232, allowing the gravel pack to continuously form as the coiled shunt tube 232 is conveyed upward in the wellbore 114. Upon forming of the gravel pack in the wellbore 114, the coiled shunt tube 232 may be removed from the wellbore 114 and fluid from the formation 102 may be produced to the surface 104 via the wellbore tubular 220.

Figure 7:
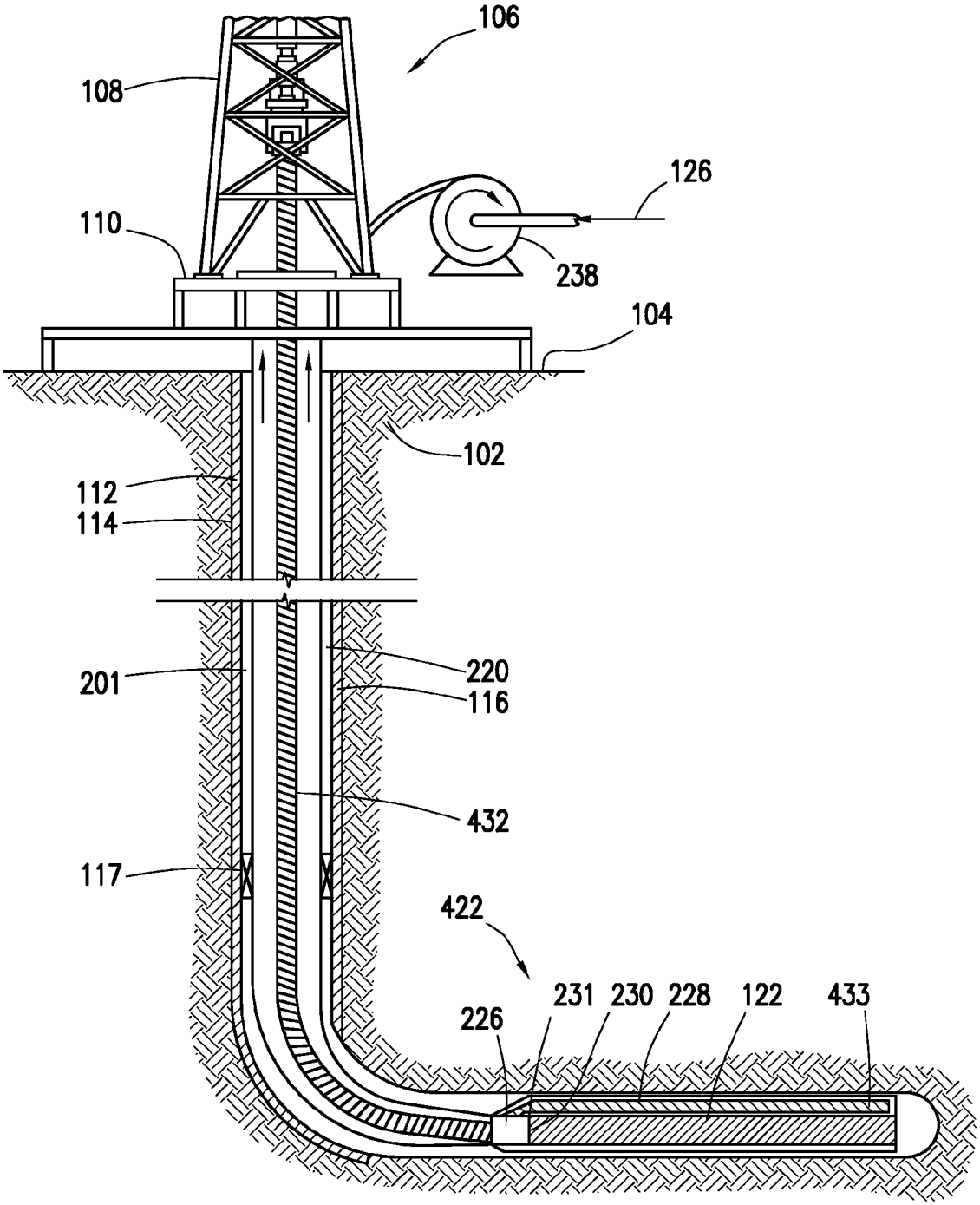
FIG. 7 is a cut-away view of another embodiment of a wellbore servicing system according to an embodiment.

Referring to FIG. 7, another example of a wellbore operating environment in which a well screen assembly may be used is shown. This configuration is similar in many respects to the configuration of FIG. 4. However, in this embodiment the wellbore tubular 220 comprises a downhole section 422 that generally includes the well screen assembly 122, a continuous section of coiled tubing 432 coupled to a shunt tube system 433, and a disconnect tool 426 disposed in the wellbore 114. The coiled tubing 432 may be fluidly coupled to the shunt tube system 433 of the well screen assembly 122, and the gravel pack operation may proceed, at least in part, by pumping the sand/gravel slurry through the coiled tubing 432 and into the shunt tube system 433 of the well screen assembly 122. The gravel pack operation may be carried out using only the coiled tubing 432 and shunt tube system 433 of the well screen assembly 122, or the gravel pack operation may use the coiled tubing 432 and shunt tube system 433 at a desired time (e.g., upon the formation of a sand bridge). In an embodiment, the shunt tube system 433 comprises a coiled shunt tube as described above with respect to FIGS. 1-3C. In the embodiment illustrated of FIG. 7, the wellbore operating environment includes coiled tubing 432 that may be at least partially disposed within tubular 220. In the downhole section 422 of the tubular string 220, a shunt tube system 433, for example the coiled shunt tube described with respect to FIGS. 1-3C, may be disposed along the screen assembly 122. While described in terms of a coiled shunt tube system 433, any suitable shunt tube system may be used with the coiled tubing 432 to receive the sand/gravel slurry 126 from the surface of the wellbore.

A disconnect tool 426 may be configured to allow for the coiled tubing 432 to be coupled to the shunt tube system 433. In some embodiments, the coiled tubing 432 may transition from being disposed within the wellbore tubular 220 above the disconnect tool 426 to be disposed outside of the wellbore tubular 220 below the disconnect tool 426, where the coiled tubing 432 may be coupled to the shunt tube system 433. The disconnect tool 426 may be configured to disconnect or sever the coiled tubing 432, allowing the coiled tubing 432 disposed above the disconnect tool 426 to be retracted via coiled tubing reel 238, while leaving the shunt tube system 433 within the wellbore. In an embodiment, the disconnect tool 426 may comprise a slot that extends from the internal throughbore of the crossover tool 226 to an exterior of the tool 226, allowing for the throughbore of coiled tubing, such as tubing 232, through the slot. Downhole section 422 further includes a shroud or outer body 228 disposed about the coiled tubing 432 and well screen assembly 122.

In an embodiment, coiled tubing 432 is configured to receive the sand/gravel slurry 126 at the surface 104. The slurry 126 may be introduced into the wellbore 114 via an internal throughbore of the coiled tubing 432. In this embodiment, the shunt tube system 433 along the screen assembly 122 may include perforations and/or packing tubes configured to deliver the slurry 126 to the wellbore 114, as described in more detail herein. As the slurry 126 flows out of the screen assembly 122 via perforations in the coiled tubing 432, a gravel pack may be formed in a portion of the wellbore 114 adjacent the screen assembly. Once the gravel pack is formed in a suitable portion of the wellbore 114, the disconnect tool 426 may be actuated, allowing for the disconnecting of the coiled tubing 432 and the retrieval of the portion of the coiled tubing 432 above the disconnect tool 426 via the reel 238. In an embodiment, because the slurry 126 may not be introduced into the wellbore 114 via the annulus 201 at the surface 104, the likelihood of any possible leak off paths from permeable zones in the formation 102 may be reduced, and the density of slurry 126 may range as high as about 10 to about 15 pounds of sand/gravel per gallon of slurry.

In an embodiment, the well screen assembly 122 may further comprise a sliding sleeve 230 that is disposed at an upward end 231 of the well screen assembly 122. The sliding sleeve 230 is configured to close the disconnect tool 426, thus sealing or at least restricting the passage of fluid between an internal throughbore of the wellbore tubular 220 and an exterior of the wellbore tubular 220 at the disconnect tool 426. In an embodiment, sliding sleeve 230 may also be configured to disengage or sever the coiled tubing 432 at the disconnect tool 426, freeing the portion of the coiled tubing 432 above the disconnect tool 426. Sliding sleeve 230 may be actuated by passing an obturating device, such as a ball or dart, from the surface 104 to the sliding sleeve 230 via the internal throughbore of the wellbore tubular 220. In another embodiment, sliding sleeve 230 may be actuated via pressurizing an internal throughbore of the wellbore tubular 220 or by pressurizing the annulus 201 of the wellbore 114.

In this embodiment, the well screen assembly 122 may be assembled at the rig 106 in the same manner described with respect to FIG. 1. For example, as the wellbore tubular 220 is run into the wellbore 114, the coiled shunt tube 432 may be unreeled at reel 238 and coupled to the wellbore tubular 220 at the surface 104. In this embodiment, shroud 228 may be omitted in order to allow for this particular form of assembly. In some embodiments a multi-portion outer body member may be used to enclose the wellbore tubular and shunt tube system 433. In some embodiments, well screen assembly 122 may be prefabricated before being introduced into the wellbore 114 at the surface 104. In this embodiment, the well screen assembly 122 may include the outer member or shroud 228.

Referring to FIG. 7, another method for operating a well system will now be herein disclosed. In an embodiment, a wellbore 114 is provided within a subterranean formation 102. A rig 106 may also be provided that is suitable for performing a completion operation for the wellbore 114 that may include the installation of a gravel pack in a portion of the wellbore 114. In this embodiment, a wellbore tubular 220 comprising a well screen assembly 122 may be introduced or run into the wellbore 114 at the rig 106. The well screen assembly 122 may comprise a disconnect tool 426, coiled tubing 432 coupled to a shunt tube system 433, and a filter media 204. In an embodiment, the well screen assembly 122 may be pre-fabricated before being introduced into the wellbore 114 and may include a shroud or outer member 228. In another embodiment, the coiled tubing 432 may be coupled to the wellbore tubular 220 as the wellbore tubular 220 is run into the wellbore 114, similarly to the installation of the coiled tubing in the embodiment of FIGS. 1-3D. As the well screen assembly 122 is run into the wellbore 114, the coiled tubing 232 is disposed external of the wellbore tubular 220 until it passes into an internal throughbore of the wellbore tubular 220 at the disconnect tool 426. Wellbore tubular 220 and screen assembly 122 may be run into the well until the assembly 122 is at a suitable location in the formation 102.

At this point, a gravel slurry 126 suitable for forming a gravel pack may be pumped into the coiled tubing 432 at the surface 104 where it may flow into the shunt tube system 433 and be displaced into the wellbore 114. As the slurry 126 is pumped into the wellbore 114, it may be displaced out of one or more perforations in the shunt tube system 433. In an embodiment, the gravel slurry 126 pumped into the wellbore 114 via the coiled tubing 432 may have a density ranging approximately between about 10 and about 15 pounds of sand/gravel per gallon of slurry. The gravel slurry 126 may be continuously pumped into the wellbore 114 to form a gravel pack in the wellbore 114 proximal to the well screen assembly 122. After a gravel pack has been formed in the wellbore 114, the disconnect device may be actuated via a sliding sleeve 230 of the assembly 122. In an embodiment, an obturating member, such as a ball or dart, may be pumped down the wellbore tubular 220 from the surface until it engages and actuates the sliding sleeve 230. The sliding sleeve 230, in response to engagement from an obturating member, may slide upward until engaging the disconnect device 426. The disconnect device 426 may then disengage or sever the coiled tubing 432 from the shunt tube system 433 at the disconnect device 426. At this point, the coiled tubing portion 432 above the disconnect device 426 may be retracted out of the wellbore 114, for example, using the coiled tubing reel 238. Fluid from the formation 102 may then be produced to the surface 104.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A wellbore shunt tube system comprising:

a wellbore tubular;

a coiled shunt tube disposed along the wellbore tubular, wherein the coiled shunt tube is configured to be unwound from a reel, wherein the coiled shunt tube comprises a transport tube in fluid communication with a plurality of packing tubes;

a coiled tubing coupled to the transport tube, wherein the coiled tubing is configured to receive a slurry and provide a flowpath to the transport tube; and a disconnect device, wherein the disconnect device is configured to releasably couple the coiled tubing to the transport tube.

2. The system of claim 1, further comprising a retaining member, wherein the retaining member is configured to retain the coiled shunt tube to the wellbore tubular.

3. The system of claim 1, further comprising an outer body member disposed about the coiled shunt tube and the wellbore tubular.

4. The system of claim 1, wherein an upper end of the transport tube is in fluid communication with the exterior of the wellbore tubular.

5. A method of gravel packing comprising:

passing a slurry through a coiled shunt tube, wherein the coiled shunt tube is disposed along a sand screen assembly;

passing the slurry from the coiled shunt tube to an annulus between an outside of the sand screen assembly and a wellbore wall, wherein passing the slurry from the coiled shunt tube to an annulus comprises emitting a gravel slurry from a lower terminal end of the coiled tubing;

retracting the coiled shunt tube as the gravel slurry is passing through the coiled shunt tube;

disposing the slurry about the sand screen assembly; and forming a gravel pack in response to disposing the slurry about the sand screen assembly.

6. The method of claim 5, wherein the slurry has a density between about 10 and about 15 pounds of sand or gravel per gallon of slurry.

7. A method for forming a tubular string, comprising:

engaging a coiled shunt tube with a wellbore tubular string, wherein the coiled shunt tube is slidingly engaged with the wellbore tubular string, wherein the wellbore tubular string comprises a plurality of interconnected joints of wellbore tubular, and wherein the coiled shunt tube comprises a continuous length of shunt tube;

coupling the coiled shunt tube along the wellbore tubular string; and disposing the coupled coiled shunt tube and wellbore tubular string within a wellbore.

8. The method of claim 7, further comprising engaging the coiled shunt tube to a disconnect device at an upper end; and coupling a coiled tubing to the disconnect device.

9. The method claim 7, wherein the coiled shunt tube is coupled to a crossover tool, and wherein the coiled shunt tube passes from an interior of the wellbore tubular string to an exterior of the wellbore tubular string at the crossover tool.

10. A wellbore shunt tube system comprising:

a wellbore tubular; and a coiled shunt tube disposed along the wellbore tubular, wherein the coiled shunt tube is configured to be unwound from a reel, wherein the coiled shunt tube has a lower terminal end configured to emit a fluid; and a reel, wherein the reel is configured to retract the coiled shunt tube from a wellbore as a gravel slurry is flowed through the coiled shunt tube to the terminal end of the coiled shunt tube.

11. The system of claim 10, further comprising a retaining member, wherein the retaining member is configured to retain the coiled shunt tube to the wellbore tubular.

12. The system of claim 10, further comprising an outer body member disposed about the coiled shunt tube and the wellbore tubular.

13. The system of claim 10, further comprising a leakoff tube disposed along the wellbore tubular, wherein the leakoff tube is configured to provide a fluid communication pathway along the wellbore tubular.

14. The system of claim 10, further comprising a pressure sensor, wherein the pressure sensor is configured to provide a pressure signal, and wherein the reel is further configured to retract the coiled shunt tube from the wellbore at a rate based at least in part on the pressure signal.

15. A method of gravel packing comprising:

passing a slurry through a coiled shunt tube, wherein the coiled shunt tube is disposed along a sand screen assembly, and wherein a coiled tubing is coupled to the coiled shunt tube at a disconnect device;

passing the slurry from the coiled shunt tube to an annulus between an outside of the sand screen assembly and a wellbore wall;

disposing the slurry about the sand screen assembly;

forming a gravel pack in response to disposing the slurry about the sand screen assembly;

disconnecting the coiled tubing from the disconnect device; and retracting the coiled tubing from the wellbore.

16. The method of claim 15, wherein the slurry has a density between about 10 and about 15 pounds of sand or gravel per gallon of slurry.

17. The method of claim 15, wherein passing the slurry through the coiled shunt tube comprises: passing the slurry through a transport tube, and passing the slurry from the transport tube to a packing tube.

18. The method of claim 17, wherein passing the slurry from the coiled shunt tube to the annulus comprises passing the slurry through one or more ports in the packing tube to the annulus.

19. A method for forming a tubular string, comprising:

engaging a coiled shunt tube with a wellbore tubular string, wherein the wellbore tubular string comprises a plurality of interconnected joints of wellbore tubular, and wherein the coiled shunt tube comprises a continuous length of shunt tube;

coupling the coiled shunt tube along the wellbore tubular string;

engaging the coiled shunt tube to a disconnect device at an upper end;

coupling a coiled tubing to the disconnect device and disposing the coupled coiled shunt tube, the disconnect device, the coiled tubing, and wellbore tubular string within a wellbore.

20. The method of claim 19, wherein the coiled shunt tube is slidingly engaged with the wellbore tubular string.

* * * * *